US005362297A

United States Patent [19]

Muir

[11] Patent Number: 5,362,297

[45] Date of Patent: Nov. 8, 1994

[54] EXERCISE MACHINE

[76] Inventor: Arthur M. Muir, 207 Van Doren Dr., Natrona Heights, Pa. 15065

[21] Appl. No.: 46,779

[22] Filed: Apr. 14, 1993

[51] Int. Cl.[5] ..... A63B 21/00

[52] U.S. Cl. ..... 482/134; 482/112; 482/137

[58] Field of Search ..... 482/112–113, 482/133–138, 111

[56] References Cited

U.S. PATENT DOCUMENTS

| | | | |
|---|---|---|---|
| 3,912,265 | 10/1975 | Muir . | |
| 4,235,437 | 11/1980 | Ruis et al. . | |
| 4,291,787 | 9/1981 | Brentham et al. . | |
| 4,462,252 | 7/1984 | Smidt et al. | 482/134 X |
| 4,478,412 | 10/1984 | Muir . | |
| 4,565,368 | 1/1986 | Boettcher | 482/134 |
| 4,645,205 | 2/1987 | Wolff | 482/113 X |
| 4,722,525 | 2/1988 | Brentham | 482/113 X |
| 4,732,379 | 3/1988 | Bodine-Reese et al. | 482/134 |
| 4,765,614 | 8/1988 | Shute | 482/113 X |
| 4,787,375 | 11/1988 | Krause | 482/134 X |
| 4,880,227 | 11/1989 | Sowell | 482/112 X |
| 4,911,435 | 3/1990 | Johns | 482/134 X |
| 5,100,128 | 3/1992 | Mabry et al. | 482/134 |

*Primary Examiner*—Robert Bahr

*Attorney, Agent, or Firm*—Andrew Alexander

[57] ABSTRACT

Disclosed is an exercise machine suitable for exercising upper body muscles of an exerciser in a wheelchair. The machine comprises a base frame having a front end and a back end; two spaced apart columns upwardly extending from the base frame at the front end thereof; means for restraining backward movement of the exerciser. An operating arm is pivotally mounted between the columns at an upper region thereof, the operating arm comprising: (i) an upwardly extending first lever pivotally mounted to the columns; and (ii) a downwardly extending second lever fixedly connected to the upwardly extending first lever, the downwardly extending second lever terminating in a grip bar for the exerciser, the operating arm pivoting to permit upward/downward and forward/backward movement of the grip bar. Means is provided for restraining lap movement of the exerciser using the machine. A restraining force is attached to the arm to resist movement of the exerciser.

18 Claims, 8 Drawing Sheets

EXERCISE MACHINE

BACKGROUND OF THE INVENTION

This invention relates to an exercise machine, and more particularly this invention relates to an exercise machine suitable for an exerciser in a wheelchair.

While there has been a great increase in the number of exercise machines, there have been very few machines which can be used safely by occupants of a wheelchair. The importance of exercise to persons restricted to wheelchair use has been found to be very important, particularly in developing the upper body muscle groups. Development of these muscle groups is particularly important for endurance as well as general well being. Thus, there is a great need for an exercise machine which can be used safely and conveniently by occupants of a wheelchair with little or no help or aid from an attendant. The subject invention provides such an exercise machine which can be used to do lateral pull downs, curls, tricep extensions, military presses, bench presses and rowing, for example. Further, the load on the subject exercise machine can be varied and changed by the exerciser as desired, particularly when used in conjunction with fluid flow resistance or a hydraulic system of the invention.

SUMMARY OF THE INVENTION

An improved exercise machine suitable for exercising upper body muscle groups of an exerciser or occupant in a wheelchair is disclosed. The exercise machine comprises: a base frame having a front end and a back end; two spaced apart columns upwardly extending from the base frame at the front end thereof; a first member and a second member spaced apart and upwardly extending from the back end of the base frame, the first and second members spaced apart sufficiently to permit an exerciser in a wheelchair to pass therethrough; a gate pivotally mounted on the first member and releasably attached to the second member, the gate restraining backward movement of the exerciser; an operating arm pivotally mounted between the columns at an upper region thereof. The operating arm comprises: (i) an upwardly extending first lever pivotally mounted to the columns; and (ii) a downwardly extending second lever fixedly connected to the upwardly extending first lever, the downwardly extending second lever terminating in a grip bar for the exerciser. Further, the operating arm extends in the direction of the gate, the operating arm pivoting to permit upward and downward movement of the grip bar. A lap restraint arm is mounted between the columns and extending towards the gate, the lap restraint arm terminating in a lap restraint pad, the pad designed to restrain lap movement of the exerciser using the machine. A restraining force is attached to the arm to resist movement of the exerciser or provide a force for the exerciser to work against.

It is an object of the invention to provide an exercise machine for use by an exerciser in a sitting position.

It is another object of the invention to provide an improved exerciser for use by a person in a wheelchair.

It is a further object of the invention to provide an improved exercise machine suitable for use in exercising the upper body muscle groups of the occupant of a wheelchair.

It is yet a further object of the present invention to provide an exercise machine for a wheelchair occupant wherein the machine is capable of performing lateral pull downs, curls, tricep extension, military or bench presses and rowing exercises.

And yet it is a further object of the invention to provide an exercises machine for an occupant or exerciser in the sitting position wherein the occupant can control or change the level of resistance or force required for each exercise.

These and other objects of the invention will be obvious from the specification, claims and accompanying drawings.

DETAILED DESCRIPTION OF THE PREFERRED EMBODIMENTS OF THE INVENTION

Figure 1:
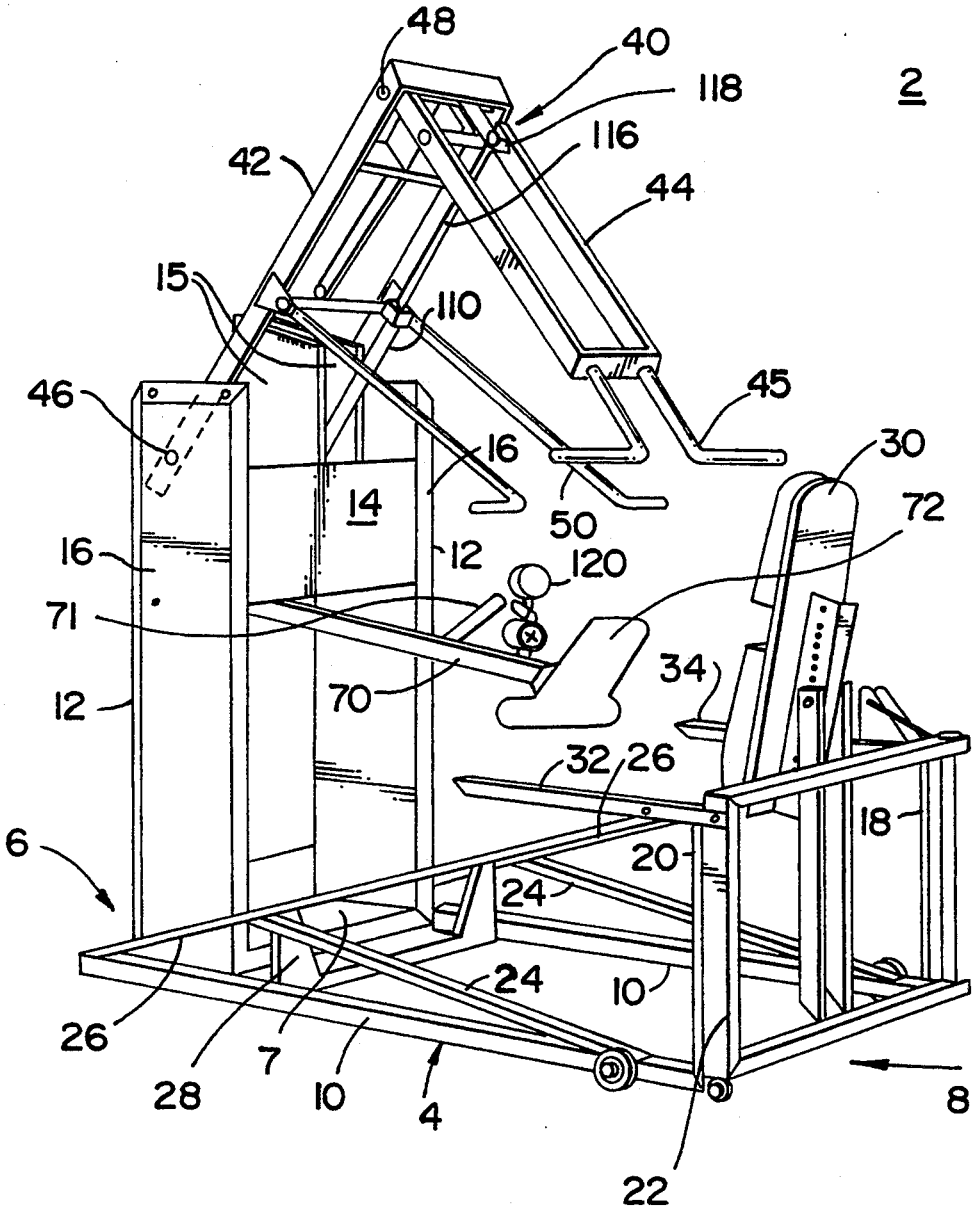
FIG. 1 is a perspective view of the exercise machine in accordance with the invention.
Figure 6:
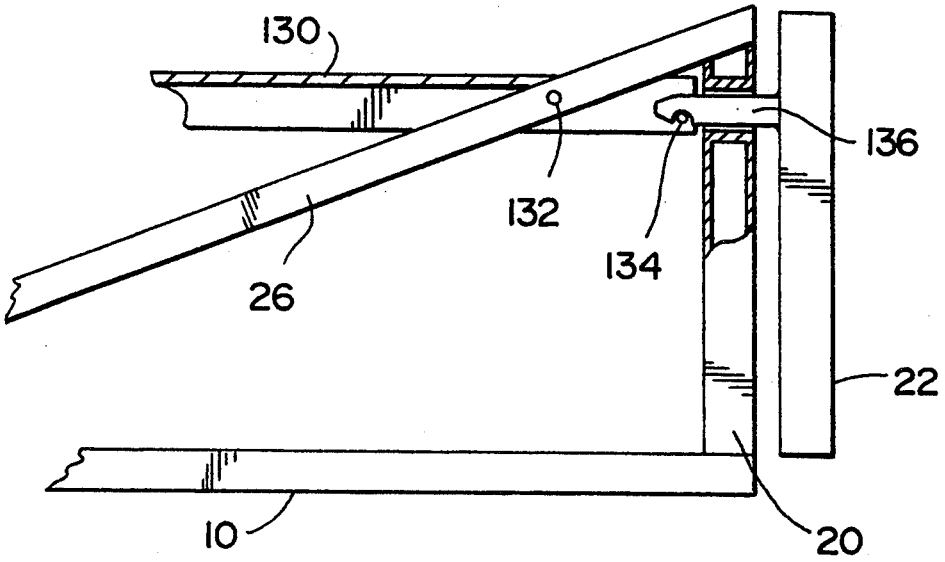
FIG. 6 is a section view of the gate latch mechanism.
Figure 7:
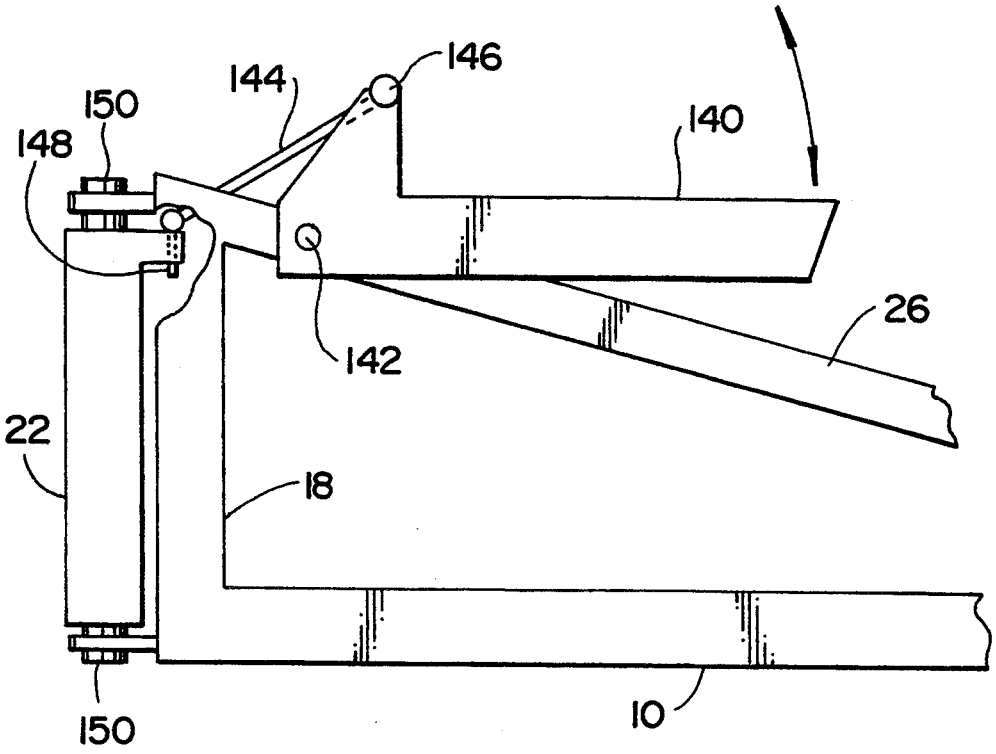
FIG. 7 is a section view of the gate opening mechanism.

FIG. 1 shows a perspective view of an exercise machine 2 in accordance with the invention showing a base frame 4 having a front end 6 comprising member 7 and a back end 8, the front end and back end may be joined by side rails 10. Spaced apart columns 12 are joined to and extend upwardly from base frame 4. A cross member 14 joins columns 12 at upper regions 16 thereof. At back end 8, a first member 18 and second member 20 upwardly extend from side rails 10. A gate 22 is pivotally mounted to first member 18 and is releasably attached to second member 20. Reinforcing members 24 and 26 may be provided and join upper regions of first and second members 18 and 20 to side rails 10. Further, a reinforcing cross member 28 may be provided to provide further structural rigidity to exercise machine 2. This structural design is particularly suitable if the exercise machine is portable. It will be understood that columns 12 and first and second members 18 and 20 may be embedded or attached to in a floor, and such is encompassed within the purview of the invention. First and second members 18 and 20 are spaced sufficiently apart to permit entry of a wheelchair into exercise machine 2. Gate 22 can be provided with a back restraint 30 which may be adjustable upwardly and downwardly as desired. Further, gate 22 is provided with a latching mechanism 32 (see FIG. 6) which permits latching and unlatching by use of arm 32 and is operable by the exerciser in the machine. In addition, a gate 22 is provided with a gate opening and closing mechanism 34 (see FIG. 7) which enables the occupant or exerciser using the machine to open and close the gate as desired. It will be appreciated that while a rectangular shaped gate is shown, a bar member extending between first member 18 and second member 20 can serve as a gate whose function is to restrain a wheelchair from rolling or moving backwards out of or away from the machine during exercises such as military presses or bench presses.

The exercise machine is provided with an operating arm referred to generally as 40. Operating arm 40 is comprised of an upwardly extending first lever member 42 and downwardly extending second lever or member 44 which is shown terminating in a grip bar 45. Upwardly extending first lever or member 42 is connected to columns 12 by connector 46. The connection may be a pivotal connection which permits operating arm 40 to rotate (see FIG. 9) about connector 46 when, for example, the exerciser is performing lateral pull down exercises; in which case, operating arm comprised of upwardly extending first lever 42 and downwardly extending second lever 44 operates as a single or unified beam. That is, when upwardly extending lever 42 is permitted to pivot or rotate about connector 46, then downwardly extending second lever 44 is fixedly or rigidly connected at connector 48 to upwardly extending lever 42 in order that operating arm 40 act as a single beam.

In accordance with the present invention, upwardly extending first lever 42 of operating arm 40 can be either pivotally connected by connector 46 to columns 12 or upwardly extending first lever 42 can be fixedly or rigidly connected to columns 12 so that upwardly extending first lever 42 is not permitted to pivot at connector 46. Whether first lever 42 pivots or does not pivot about connector 46 depends on the exercise the exerciser sitting at the exercise machine selects. For example, if the exerciser selects lateral pull down exercises, then first lever 42 of operating arm 40 will be required to pivot about connector 46, as sown in FIG. 2.

Further, in accordance with the present invention, when upwardly extending first lever 42 is fixedly or rigidly connected to column 12, then downwardly extending second lever 44 is required to pivot about connector 48. For example, lever 42 would be fixedly connected to column 12 if the exerciser at the machine selected an exercise such as rowing.

Figure 9:
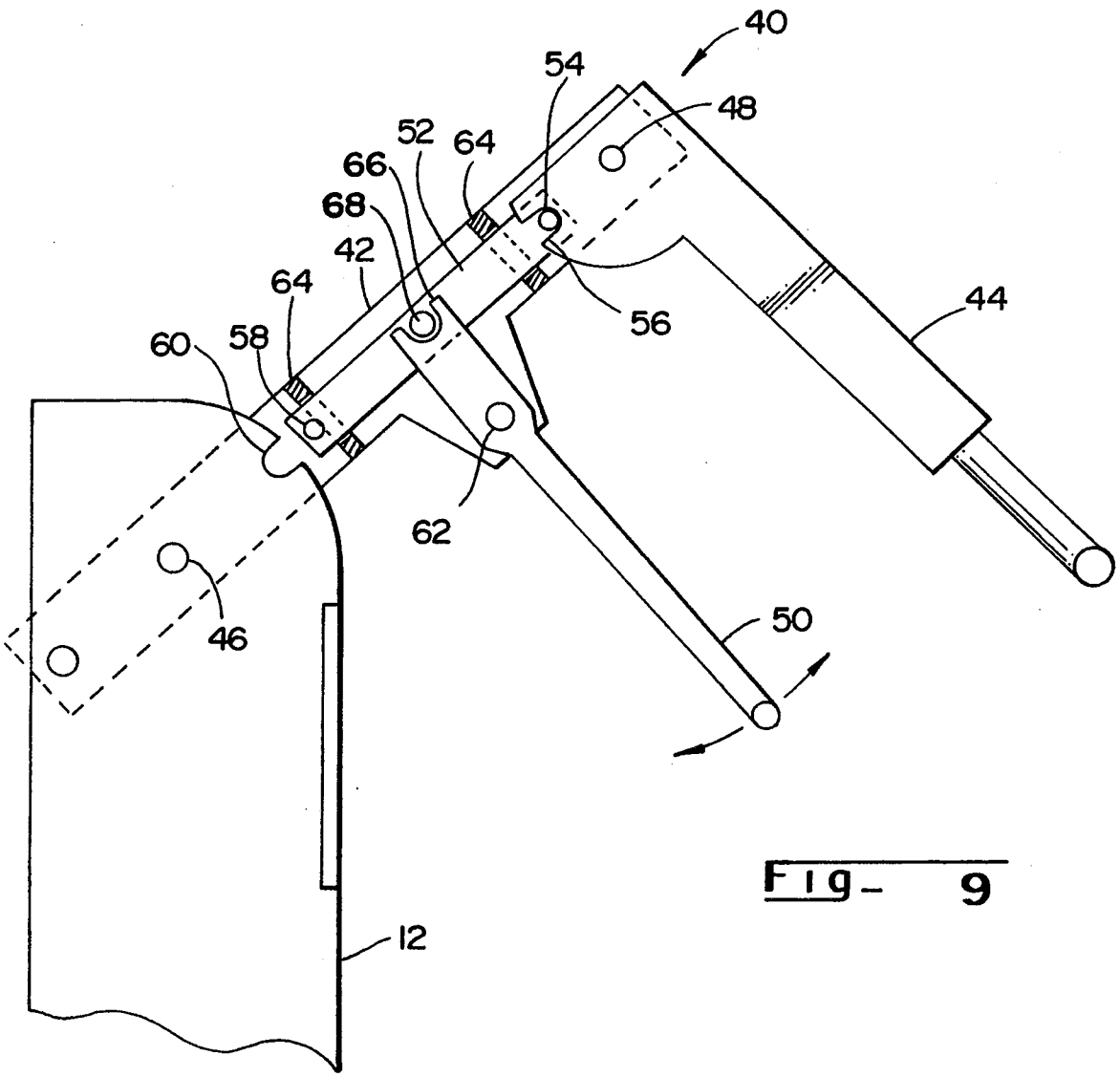
FIG. 9 is a sectional view showing the mechanism which permits switching the exercise machine between lateral pull down exercises and rowing exercises.

The selection of pivoting about connector 46 or connector 48 is made by the operator or exerciser, depending on the type of exercises desired. The selection can be made by the exerciser while using the machine by lock bar arm 50, as shown in FIG. 9. For example, when it is desired to do lateral pull down exercises, then lock bar arm 50 is pushed in a downward direction. This has the effect of sliding bar 52 along lever 42 in the direction of connector 48 where pin 54 engages slot 56 of lever 44, thereby fixedly or rigidly connecting lever 42 to lever 44 and preventing rotation about connector 48. At the same time, pin 58 disengages slot 60 in column 12 permitting operating arm 40 to pivot about connector 46, as shown in FIG. 9. Similarly, if it is desired to perform rowing exercises, then lock bar arm 50 would be pushed in an upward direction requiring lock bar arm 50 to pivot about pivot point 62, sliding bar 52 downward along lever 42 where pin 58 would engage slot 60, thereby preventing rotation of operating arm about connector 46. Bar 52 is held on lever 42 by keepers 64, and lock bar arm 50 slides bar 52 by means of fork 66 and pin 68. Thus, it will be seen that the exerciser while in the exercising machine can easily change or select the type of exercise desired by means of lock bar arm 50.

Figure 2:
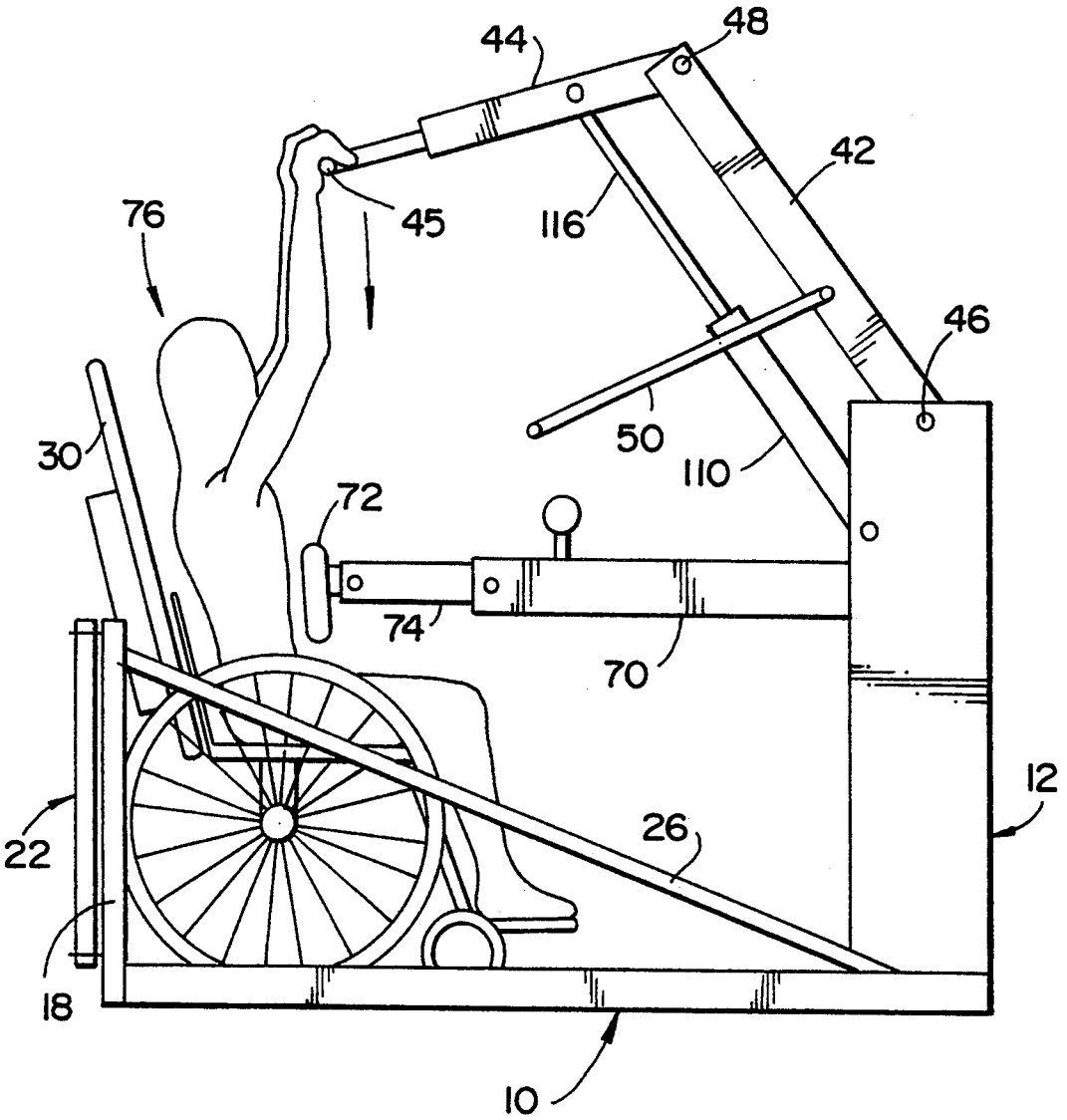
FIG. 2 is a side view of the exercise machine showing an exerciser at the beginning of a lateral pull down.
Figure 3:
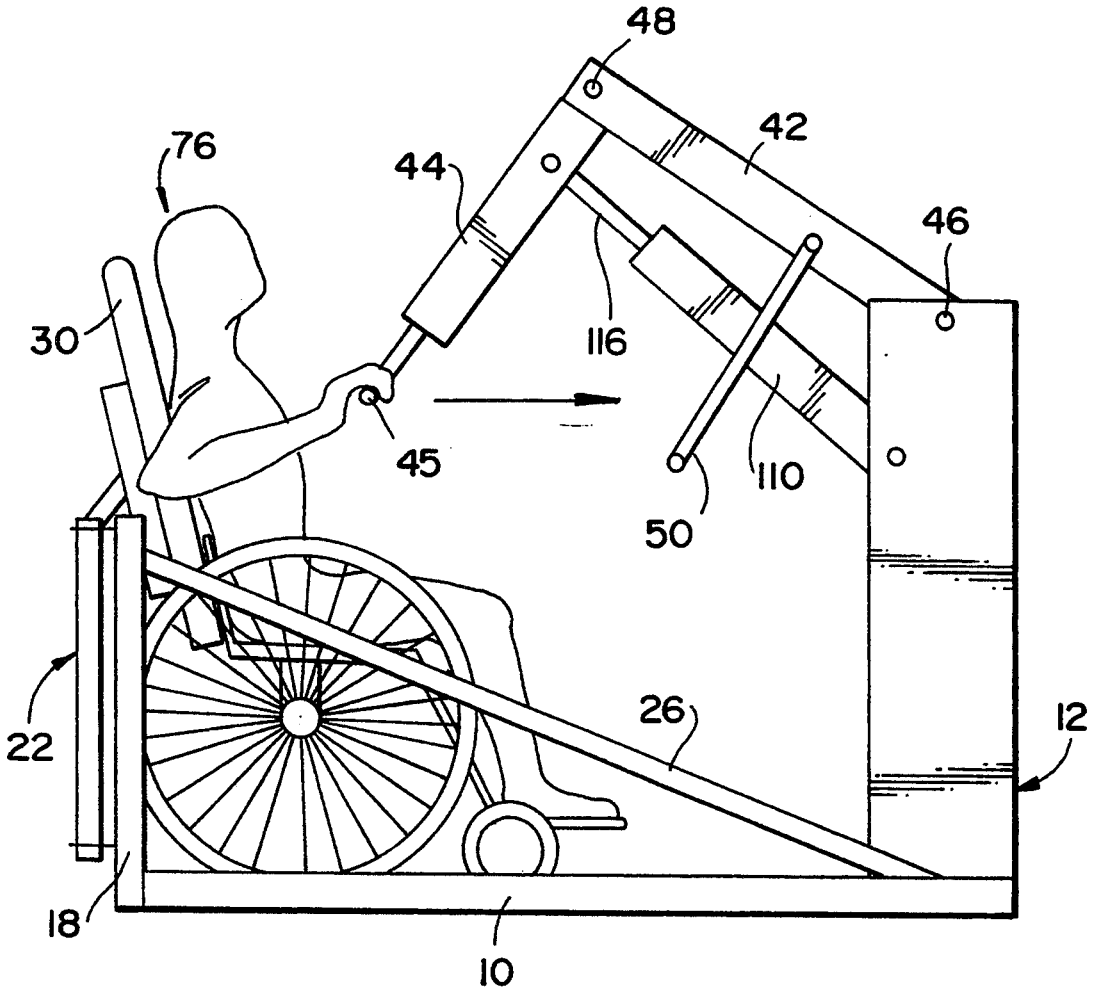
FIG. 3 is another side view of the exercise machine showing an exerciser at the start of a bench press from the seated position.
Figure 4:
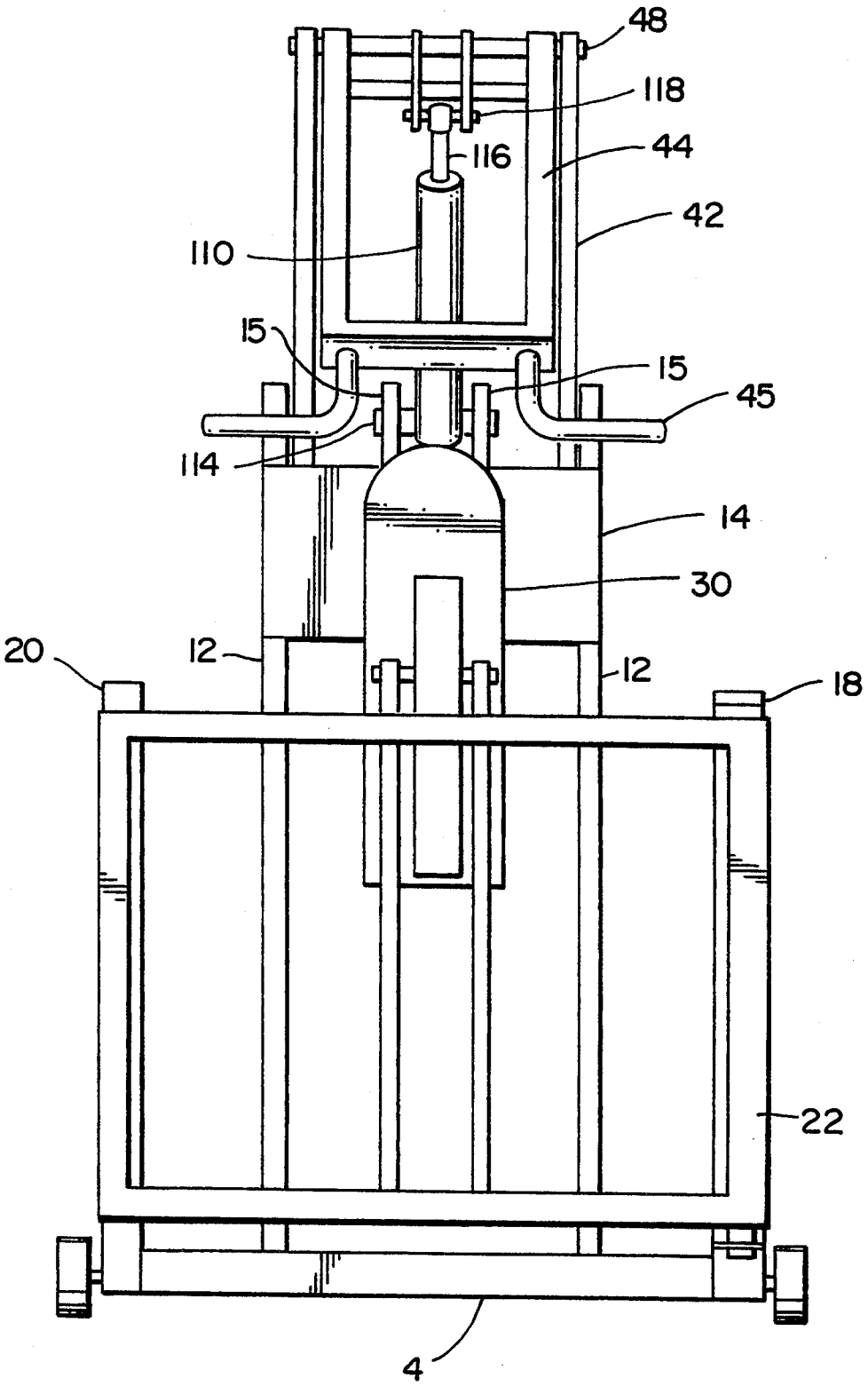
FIG. 4 is a view of the exercise machine from the gate side showing the gate closed.
Figure 8:
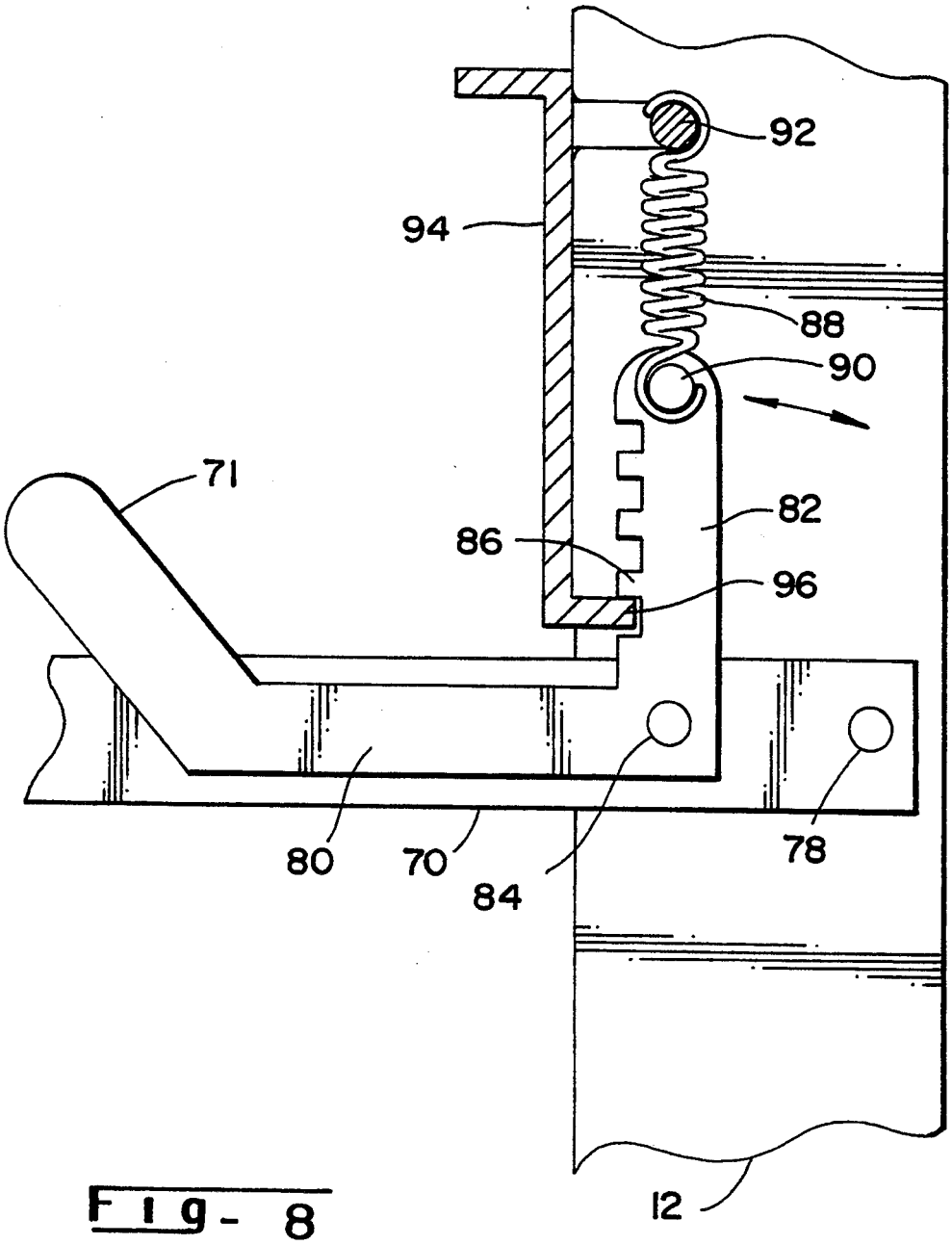
FIG. 8 is a sectional view showing the mechanism for lowering and raising the lap resistant arm.

A lap restraint arm 70 having a lap restraint pad 72 is provided. Lap restraint arm 70 is shown in FIGS. 1, 2 and 8 connected to column 12. As shown in FIG. 2, lap restraint arm 70 can have an extension arm 74 which can be adjusted towards exercise machine operator or exerciser 76 to fit comfortably to the abdomen or lap. For example, if rowing exercises were being performed, then lap restraint 72 serves to keep exerciser 76 stationary by providing a counter force against the abdomen. In addition, lap restraint arm 70 can be adjusted upwardly or downwardly onto the exercise machine operator's lap. This adjustment of the lap restraint pad onto the operator's lap helps in restraining the operator in the sitting position when lateral pull down exercises, for example, are being performed. The upward or downward movement can be made by the exerciser using handle 71, as shown in FIG. 8. In FIG. 8, lap restraint arm 70 is shown pivotally connected to column 12 with connector 78. Further, handle 71 is shown attached to arm 80 which has member 82 extending upwardly therefrom. Arm 80 is pivotally connected to lap restraint arm 70 by connector 84. Further, member 82 is provided with teeth 86 and is attached to column 12 through spring 88. Pin 90 connects spring 88 to member 82, and pin 92 connects spring 88 to column 12. Also, connected or attached to column 12 is flange 94 having projection 96 which engages teeth 86 of member 82. As shown in FIG. 8, lap restraint arm 70 is adjusted to provide lap restraint pad 72 in the highest position. To adjust lap restraint pad 72 downwardly, handle 71 is pushed away from the exerciser using the machine, and lap restraint pad 72 is pushed down. Thus, lap restraint arm 70 rotates about connector 78 until flange projection 96 engages the next tooth on member 82. Similarly, handle 71 can be turned laterally to permit extension 74 (FIGS. 1 and 2) to be adjusted by the exerciser.

While lap restraining arm 70 is shown connected to column 12, it will be appreciated that other methods of mounting such as attaching to a member (not shown) extending from reinforcing members 26 could be used, and such is contemplated within the purview of the invention.

Figure 5:
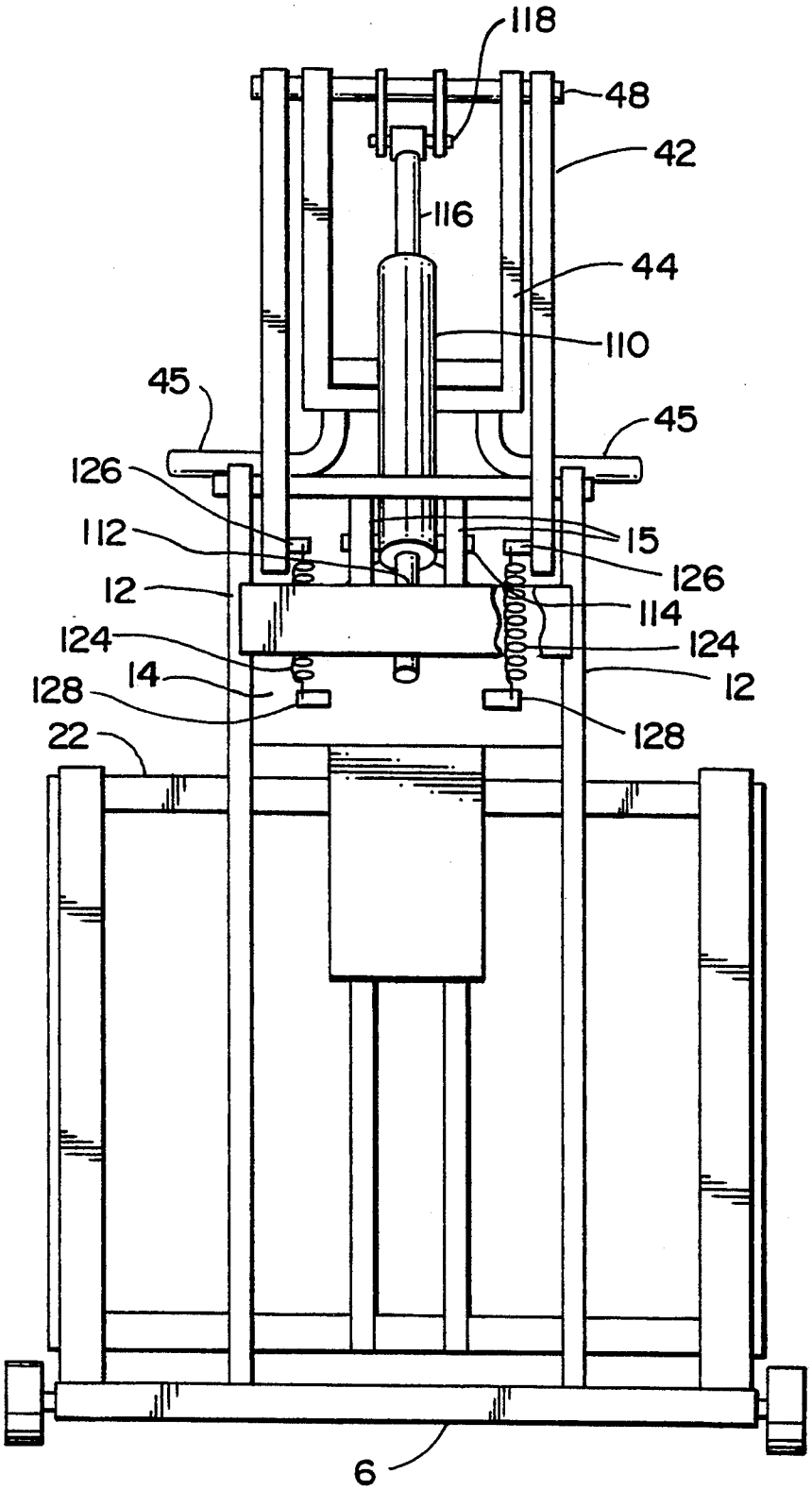
FIG. 5 is a front view or a view from the opposite end shown in FIG. 4.

In the preferred embodiment of the present invention, the resistance force against which the exerciser works while exercising is provided by a hydraulic system. In the present invention, a hydraulic cylinder 110 is used and is pivotally connected at one end to brackets 15 by connector 114. Brackets 15 are attached to cross members 14 (see FIGS. 1 and 5). The other end of hydraulic cylinder 110 is pivotally attached by rod 116 to lever 44 (see FIGS. 1, 2, 4 and 5) by connector 118. Rods 112 and 116 are connected to a piston in the hydraulic cylinder. Controls 120 may be located on lap restraint arm 70 and can be adjusted by the exerciser while in the exercise machine. The controls may be adjusted in order to provide the amount of resistance force desired by the exerciser. Hydraulic systems of the type especially useful in the subject exercise machine are described in my U.S. Pat. Nos. 3,912,265 and 4,478,412, incorporated herein by reference.

Hydraulic systems are preferred for safety reasons. That is, in a hydraulic system when the exerciser stops pushing on grip bar 45, operating arm 40 does not move further because it only provides a resistance force, and thus the exerciser may stop part way through a lift with no reaction in the same way as would be experienced with weights, for example. However, while the invention has been described with respect to hydraulic systems, its application is not limited thereto. For example, a pneumatic system may be used, as well as weights, springs and stretching bands, etc., and such are encompassed within the purview of the invention.

In the present invention, it is preferred to have the operating arm balanced approximately at chest level when the exerciser first enters the exercise machine. This may be accomplished by providing counter weights on the end of lever 42. Another method of balancing operating arm 40 is to use springs 124 (FIG. 5) which are attached to lever 42 by pins 126 and to brackets 15 by pins 128.

In the present invention, gate 22 may be locked and unlocked by the exerciser by lifting arm 130 which pivots about pin 132 and disengages pin 134 from lock bar 136 attached to gate 22. In addition, the exerciser can open gate 22 after the lock mechanism has been disengaged by lifting up on arm 140 which pivots about pin 142 and pushes on arm 144 which is pivotally connected to arm 140 at pin 146. Arm 144 is pivotally connected to gate 22 with connector 148 and pushes gate 22 to turn on hinge 150.

While the invention has been described in terms of preferred embodiments, the claims appended hereto are intended to encompass other embodiments which fall within the spirit of the invention.

What is claimed is:

1. An exercise machine suitable for exercising upper body muscles of an exerciser in a wheelchair using said machine, the machine comprising:

(a) a base frame having a front end and a back end;

(b) two spaced apart columns upwardly extending from the base frame at the front end thereof;

(c) means for restraining backward movement of said exerciser;

(d) an operating arm pivotally mounted between said columns at an upper region thereof, said arm comprising:

(i) an upwardly extending first lever mounted to said columns; and (ii) a downwardly extending second lever fixedly connected to said upwardly extending first lever, the downwardly extending second lever terminating in a grip bar for said exerciser, said arm extending in the direction of said exerciser;

(e) a lap restraint arm mounted on said machine to restrain lap movement of said exerciser using said machine;

(f) a restraining force attached to said arm to resist movement of said exerciser and (g) a lock arm pivotally connected to said first lever and operable by said exerciser, said lock arm comprising a bar having one end extending towards said back end and terminating in a handle and having another end pivotally connected to a lock pin bar having a lock pin at each end of said bar, the lock pin bar slidably held in guides on said first lever wherein movement of said handle in one direction fixedly connects said first lever and said second lever and permits upward and downward movement of said grip bar, and wherein opposed movement of said handle fixedly connects said first lever to said columns and permits forward and backward movement of said grip bar.

2. The exercise machine in accordance with claim 1 wherein said lap restraint comprises an arm mounted between said columns and extending towards said back end, said lap restraint arm terminating in a lap restraint pad, wherein said lap restraint arm adjusts upwards and downwards.

3. The exercise machine in accordance with claim 1 wherein said machine comprises a first member and a second member spaced apart and upwardly extending from the back end of said base frame, said first and second members spaced apart sufficiently to permit an exerciser in a wheelchair to pass therethrough and a gate pivotally mounted on said first member and releasably attached to said second member, said gate having a back rest and restraining backward movement of said exerciser.

4. The exercise machine in accordance with claim 3 wherein said machine has a gate unlocking arm extending forward of said second member.

5. The exercise machine in accordance with claim 3 wherein said machine has a gate opening and closing arm extending forward of said first member.

6. The exercise machine in accordance with claim 1 wherein said operating arm has a bias means to hold said arm in a neutral load position.

7. The exercise machine in accordance with claim 1 wherein said restraining force is a hydraulic system including a cylinder having a piston therein connected to piston rods, said cylinder connected by connecting means to said columns and one of said rods connected to said downwardly extending second lever and a control valve forming part of said hydraulic system to increase or decrease the restraining force.

8. An exercise machine suitable for exercising upper body muscles of an exerciser in a wheelchair using said machine, the machine comprising:

(a) a base frame having a front end and a back end;

(b) two spaced apart columns upwardly extending from the base frame at the front end thereof;

(c) a first member and a second member spaced apart and upwardly extending from the back end of said base frame, said first and second members spaced apart sufficiently to permit an exerciser in a wheelchair to pass therethrough;

(d) a gate pivotally mounted on said first member and releasably attached to said second member, said gate restraining backward movement of said exerciser;

(e) an operating arm connected between said columns at an upper region thereof; said operating arm comprising:

(i) an upwardly extending first lever connected to said columns; and (ii) a downwardly extending second lever connected to said upwardly extending first lever, the downwardly extending second lever terminating in a grip bar for said exerciser, said arm extending in the direction of said gate;

(f) a lock arm pivotally connected to said first lever and operable by said exerciser, said lock arm comprising a bar having one end extending towards said gate and terminating in a handle and having another end pivotally connected to a lock pin bar having a lock pin at each end of said bar, the lock pin bar slidably held in guides on said first lever wherein downward movement of said handle fixedly connects said first lever and said second lever and permits upward and downward movement of said grip bar, and wherein upward movement of said handle fixedly connects said first lever to said columns and permits forward and backward movement of said grip bar;

(g) a lap restraint arm mounted between said columns and extending towards said gate, said lap restraint arm terminating in a lap restraint pad, said pad designed to restrain lap movement of said exerciser using said machine; and (h) a restraining force attached to said arm to resist movement of said exerciser.

9. An exercise machine suitable for exercising upper body muscles of an exerciser in a wheelchair using said machine, the machine comprising:

(a) a base having a front end and a back end;

(b) two spaced apart columns upwardly extending from the base at the front end thereof;

(c) an operating arm connected between said columns at an upper region thereof, said operating arm comprising:

(i) an upwardly extending first lever connected to said columns; and (ii) a downwardly extending second lever connected to said upwardly extending first lever, the downwardly extending second lever terminating in a grip bar for said exerciser, said arm extending in the direction of said exerciser;

(d) a lock arm pivotally connected to said first lever and operable by said exerciser, said lock arm comprising a bar having one end extending towards said exerciser and terminating in a handle and having another end pivotally connected to a lock pin bar having a lock pin at each end of said bar, the lock pin bar slidably held in guides on said first lever wherein downward movement of said handle fixedly connects said first lever and said second lever and permits upward and downward movement of said grip bar, and wherein upward movement of said handle fixedly connects said first lever to said columns and permits forward and backward movement of said grip bar;

(e) means for preventing backward movement of said exerciser during exercising;

(f) means for preventing forward movement of said exerciser during exercising; and (g) a restraining force attached to said operating arm to resist movement of said exerciser.

10. The exercise machine in accordance with claim 9 including means for preventing upward movement of said exerciser during exercising.

11. The exercise machine in accordance with claim 9 wherein said means for preventing forward movement of said exerciser is a lap restraint arm mounted between said columns and extending towards said exerciser, said lap restraint arm terminating in a lap restraint pad.

12. The exercise machine in accordance with claim 11 wherein said lap restraint arm adjusts upwards and downwards.

13. The exercise machine in accordance with claim 9 wherein said means for preventing backward movement of said exerciser during exercising comprises a first member and a second member spaced apart and upwardly extending from the back end of said base, said first and second members spaced apart sufficiently to permit an exerciser in a wheelchair to pass therethrough and a gate pivotally mounted on said first member and releasably attached to said second member.

14. The exercise machine in accordance with claim 13 wherein said gate has a back rest.

15. The exercise machine in accordance with claim 13 wherein said machine has a gate unlocking arm extending forward of said second member.

16. The exercise machine in accordance with claim 13 wherein said machine has a gate opening and closing arm extending forward of said first member.

17. The exercise machine in accordance with claim 9 wherein said restraining force comprises a hydraulic system.

18. The exercise machine in accordance with claim 9 wherein said operating arm has a bias means to hold said arm in a neutral load position.

* * * * *